US008721309B2

(12) United States Patent
Masuda

(10) Patent No.: US 8,721,309 B2
(45) Date of Patent: May 13, 2014

(54) AIRTIGHT COMPRESSOR

(75) Inventor: Masanori Masuda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 309 days.

(21) Appl. No.: 13/139,370

(22) PCT Filed: Dec. 11, 2009

(86) PCT No.: PCT/JP2009/006793
§ 371 (c)(1),
(2), (4) Date: Jun. 13, 2011

(87) PCT Pub. No.: WO2010/070851
PCT Pub. Date: Jun. 24, 2010

(65) Prior Publication Data

US 2011/0243779 A1 Oct. 6, 2011

(30) Foreign Application Priority Data

Dec. 17, 2008 (JP) ..... 2008-321143

(51) Int. Cl.

| | |
|---|---|
| ***F03C 4/00*** | (2006.01) |
| ***F04C 15/00*** | (2006.01) |
| ***F04C 2/00*** | (2006.01) |
| ***F04C 27/02*** | (2006.01) |

(52) U.S. Cl.
USPC ..... 418/94; 418/63; 418/87; 418/99; 418/270

(58) Field of Classification Search
USPC ..... 418/60, 63, 87, 94, 97–99, 270
See application file for complete search history.

(56) References Cited

U.S. PATENT DOCUMENTS 7,361,005 B2 * 4/2008 Sato ..... 418/63

FOREIGN PATENT DOCUMENTS

| | | | | |
|---|---|---|---|---|
| JP | 59224492 A | * | 12/1984 | ..... 418/94 |
| JP | 3-15601 A | | 1/1991 | |
| JP | 3-70893 A | | 3/1991 | |
| JP | 4-8784 A | | 1/1992 | |
| JP | 4-219489 A | | 8/1992 | |
| JP | 6-74176 A | | 3/1994 | |
| JP | 8-200264 A | | 8/1996 | |
| JP | 8-247062 A | | 9/1996 | |
| JP | 11-82350 A | | 3/1999 | |
| JP | 2008-208752 A | | 9/2008 | |

OTHER PUBLICATIONS

Office Action of corresponding Japanese Divisonal Application No. 2010-163137 dated Jan. 24, 2012.

(Continued)

*Primary Examiner* — Theresa Trieu
(74) *Attorney, Agent, or Firm* — Global IP Counselors

(57) ABSTRACT

An airtight compressor includes a compression mechanism disposed inside an airtight container in a position below a gas retention space. An oil supply passage supplies oil from an oil reservoir both to the gas retention space (14) and to a sliding portion of the compression mechanism in a compression space. The oil supply passage communicates the gas retention space with a second space located on an opposite side of the piston from the intake chamber. A second channel is a channel that is different from the oil supply passage. The second channel enables a gas medium to flow from the gas retention space to the second space. Preferably, passage resistance when the gas medium flows through the second channel is less than when the gas medium flows through the oil supply passage.

16 Claims, 3 Drawing Sheets

(56) References Cited

OTHER PUBLICATIONS

International Search Report of corresponding PCT Application No. PCT/JP2009/006793, dated Feb. 9, 2010.
Japanese Office Action of corresponding Japanese Application No. 2008-321143 dateed Feb. 2, 2010.
Japanese Notice of Rejection of corresponding Japanese Application No. 2008-321143 dated Apr. 20, 2010.
Japanese Notice of Allowance of correspondign Japanese Application No. 2008-321143 dated Sep. 7, 2010.
International Preliminary Report of corresponding PCT Application No. PCT/JP2009/006793, dated Jul. 5, 2011.

* cited by examiner

AIRTIGHT COMPRESSOR

CROSS-REFERENCE TO RELATED APPLICATIONS

This U.S. National stage application claims priority under 35 U.S.C. §119(a) to Japanese Patent Application No. 2008-321143, filed in Japan on Dec. 17, 2008, the entire contents of which are hereby incorporated herein by reference.

TECHNICAL FIELD

The present invention relates to an airtight compressor.

BACKGROUND ART

In conventional practice, a variety of airtight compressors, in which compression mechanisms and drive motors or the like for driving the mechanisms are housed within airtight containers, have been used in order to compress refrigerant gas or other compression media. An example of an airtight compressor is a rotary compressor in which the compression mechanism is configured from a cylinder, a roller which rotates inside the cylinder, and a blade in slidable contact with the external periphery of the roller.

In the rotary compressor disclosed in Japanese Laid-open Patent Publication No. 6-074176, an oil reservoir is formed in the bottom of an airtight container. When the compressor is operating, the lubricant oil of the oil reservoir passes through an oil supply passage formed inside a crankshaft, and the oil is supplied to the compression mechanism interior and a bearing of the crankshaft. The oil supply passage communicates a gas retention space above the compression mechanism in which compressed refrigerant gas is temporarily retained, with a compression space inside the compression mechanism.

In this rotary compressor, a hole for expelling foamed refrigerant gas which adversely affects the supplied oil is provided to an elastic bearing groove of a main bearing. This hole is also tapered in order to avoid damage between the external periphery of the roller and the distal end of the blade.

Specifically, in the structure disclosed in Japanese Laid-open Patent Publication No. 6-074176, a hole as a second channel separate from the oil supply passage is formed through a bearing end plate and opened into the gas retention space via a discharge muffler outlet.

SUMMARY

Technical Problem

However, as with the rotary compressor disclosed in Japanese Laid-open Patent Publication No. 6-074176, with an airtight compressor in which a compression mechanism and an oil reservoir are provided to the bottom of a compression mechanism inside an airtight container, there is a risk that oil will flow back to the intake side of the compressor via the oil supply passage when the compressor stops, and that drawing the back-flowed oil into the compression mechanism when the compressor starts up will cause oil compression in the compression chamber. When such oil compression occurs, there is a risk of cracking of the discharge valve, shaft damage, core misalignment, and other damage. Furthermore, during startup, there is a risk of bearing damage due to the compression mechanism interior running out of oil, which is particularly likely in an inverter compressor.

Moreover, in the compressor disclosed in Japanese Laid-open Patent Publication No. 6-074176, there is a risk that oil will be drawn up into the compression mechanism causing oil compression also when the oil level in the oil reservoir rises.

Furthermore, in the case of ultrahigh-pressure refrigerant gas such as carbon dioxide, there is a high pressure difference between the compression chamber and a high-pressure space where compressed refrigerant gas is present when the compressor stops, and the above-described discharge valve cracking and other damage problems are therefore likely to occur.

When ultrahigh-pressure refrigerant gas such as carbon dioxide is used, high-viscosity oil is used in order to improve bearing durability. There is accordingly a high possibility that the discharge valve or another component will be damaged because of the increased pressure by oil compression that compresses the back-flowed oil in the compression chamber.

Providing a non-return valve to the discharge side of the compressor is a possibility in order to avoid compression of the back-flowed oil, but this causes problems such as reduction of performance along with discharge pressure loss during normal operation, and increasing of manufacturing costs due to providing the non-return valve.

An object of the present invention is to provide an airtight compressor wherein oil backflow can be reliably avoided when the compressor stops.

Solution to Problem

An airtight compressor according to a first aspect of the present invention comprises an airtight container, a compression mechanism, an oil reservoir, an oil supply passage, and a second channel. The airtight container has an airtight space. The airtight container has a gas retention space. In the gas retention space, a compressed gas medium is temporarily retained in an upper part of the airtight space. The compression mechanism is disposed inside the airtight container in a position below the gas retention space. The compression mechanism internally has an intake chamber as a first space, and a second space. The second space is partitioned from the intake chamber by a seal surface of a piston. Moreover, the second space is a space on opposite side of the piston from the intake chamber. The compression mechanism compresses the gas medium in the intake chamber and then expels the gas medium to the gas retention space. The oil reservoir is disposed inside the airtight container in a position below the compression mechanism. The oil reservoir retains oil used to lubricate the compression mechanism. The oil supply passage supplies oil from the oil reservoir both to the gas retention space and to a sliding portion of the compression mechanism in the second space. Moreover, the oil supply passage communicates the gas retention space with the second space. The second channel is a channel that is different from the oil supply passage. The second channel enables the gas medium to flow from the gas retention space to the second space. The passage resistance when the gas medium flows through the second channel is less than the passage resistance when the gas medium flows through the oil supply passage.

Aside from the oil supply passage which supplies oil from the oil reservoir both to the gas retention space and to the second space on opposite side of the piston from the intake chamber in the compression mechanism, the airtight compressor has the second channel which enables the gas medium to flow from the gas retention space to the second space and which has low passage resistance. Therefore, when the compressor stops, the gas medium is allowed to flow back through the second channel without passing through the oil supply passage, equalizing the pressure between the gas retention space and the second space, and it is therefore possible to reliably avoid oil backflow.

An airtight compressor according to a second aspect of the present invention is the airtight compressor according to the first aspect of the present invention, wherein the second channel is formed through an end plate of a bearing which supports a rotating shaft of the compression mechanism. The second channel communicates the gas retention space with the second space.

The second channel is formed through the end plate of the bearing which supports the rotating shaft of the compression mechanism. The second channel communicates the gas retention space with the second space. Specifically, the second channel is formed through the end plate of the bearing without passing through the bearing gap in the bearing, the gap of the sliding seal, and other narrow passages. Therefore, the passage resistance difference with the bearing gap, the gap of the sliding seal, and other narrow passages which are already in proximity to the second channel, can be adjusted by managing the dimensions or shape of the second channel. As a result, the desired passage resistance difference can be reliably obtained without the need to make any large design changes to the structure of existing compressors.

An airtight compressor according to a third aspect of the present invention is the airtight compressor according to the first or second aspect of the present invention, wherein an opening of the oil supply passage on the side facing the gas retention space opens in a position higher than a top end of the end plate of the bearing that supports the rotating shaft of the compression mechanism.

Since the opening of the oil supply passage which opens on the side facing the gas retention space opens in a position higher than the top end of the end plate of the bearing that supports the rotating shaft of the compression mechanism, it is possible to prevent the oil from being drawn back in when the compressor stops and to effectively remove foamed refrigerant gas which forms within the second space during normal operation and which has a harmful effect on the supply of oil.

An airtight compressor according to a fourth aspect of the present invention is the airtight compressor according to any of the first through third aspects, wherein the oil supply passage has at least one narrow passage where the flow passage partially narrows. The oil supply passage communicates the gas retention space and the second space via the narrow passage.

The oil supply passage has at least one narrow passage where the flow passage partially narrows. Therefore, it is possible to adjust the passage resistance difference with the bearing gap, the gap of the sliding seal, and other narrow passages which are already in proximity to the narrow passage by managing the dimensions or shape of the narrow passage, and it is also possible to reliably obtain the desired passage resistance difference without the need to make any large design changes to the structure of existing compressors.

An airtight compressor according to a fifth aspect of the present invention is the airtight compressor according to any of the first through fourth aspects, wherein the compression mechanism has at least one cylinder, at least one swinging piston which swings within the cylinder, and a blade integrally connected to the swinging piston.

The compression mechanism has at least one cylinder, at least one swinging piston which swings within the cylinder, and a blade integrally connected with the swinging piston. Therefore, it is possible to avoid the damage to the sliding portion which occurs in a conventional rotary compressor due to the blade sliding over the external peripheral surface of the roller, and it is possible to prevent oil backflow.

An airtight compressor according to a sixth aspect of the present invention comprises an airtight container, a compression mechanism, an oil reservoir, an oil supply passage, and a valve. The airtight container has an airtight space. The airtight container has a gas retention space. In the gas retention space, a compressed gas medium is temporarily retained in an upper part of the airtight space. The compression mechanism is disposed inside the airtight container in a position below the gas retention space. The compression mechanism internally has an intake chamber as a first space, and a second space. The second space is partitioned from the intake chamber by a seal surface of a piston. Moreover, the second space is a space on opposite side of the piston from the intake chamber. The compression mechanism compresses the gas medium in the intake chamber and then expels the gas medium to the gas retention space. The oil reservoir is disposed inside the airtight container in a position below the compression mechanism. The oil reservoir retains oil used to lubricate the compression mechanism. The oil supply passage supplies oil from the oil reservoir both to the gas retention space and to a sliding portion of the compression mechanism in the second space. Moreover, the oil supply passage communicates the gas retention space with the second space. The valve is disposed in a flow inlet which is an opening of the oil supply passage on the side facing the oil reservoir. The valve opens and closes the flow inlet by opening when subjected to centrifugal force generated at the time of rotation of a rotating shaft of the compression mechanism, and by closing when not subjected to centrifugal force.

In a compressor in which both the oil reservoir and the compression mechanism are provided in the bottom of a high-pressure or intermediate-pressure space, an on/off valve which opens and closes by centrifugal force is provided in proximity to the flow inlet of the oil supply passage. Thereby, using a valve which uses centrifugal force makes it possible to reliably avoid oil backflow with a simple structure.

An airtight compressor according to a seventh aspect of the present invention comprises an airtight container, a compression mechanism, an oil reservoir, an oil supply passage, a second channel, and a valve. The airtight container has an airtight space. The airtight container has a gas retention space. In the gas retention space, a compressed gas medium is temporarily retained in an upper part of the airtight space. The compression mechanism is disposed inside the airtight container in a position below the gas retention space. The compression mechanism internally has an intake chamber as a first space, and a second space. The second space is partitioned from the intake chamber by a seal surface of a piston. Moreover, the second space is a space on opposite side of the piston from the intake chamber. The compression mechanism compresses the gas medium in the intake chamber and then expels the gas medium to the gas retention space. The oil reservoir is disposed inside the airtight container in a position below the compression mechanism. The oil reservoir retains oil used to lubricate the compression mechanism. The oil supply passage supplies oil from the oil reservoir both to the gas retention space and to a sliding portion of the compression mechanism in the second space. Moreover, the oil supply passage communicates the gas retention space with the second space. The second channel is a channel that is different from the oil supply passage. The second channel enables the gas medium to flow from the gas retention space to the second space. The valve is disposed in a flow inlet which is an opening of the oil supply passage on the side facing the oil reservoir. The valve opens and closes the flow inlet by opening when subjected to centrifugal force generated at the time of rotation of a rotating shaft of the compression mechanism, and by closing when not subjected to centrifugal force. The passage resistance when the gas medium flows through the second channel is less than the passage resistance when the gas medium flows through the oil supply passage.

Aside from the oil supply passage which supplies oil from the oil reservoir both to the gas retention space and to the second space on opposite side of the piston from the intake chamber in the compression mechanism, the airtight compressor has the second channel which enables the gas medium to flow from the gas retention space to the second space and which has low passage resistance. Therefore, when the compressor stops, the gas medium is allowed to flow back through the second channel without passing through the oil supply passage, equalizing the pressure between the gas retention space and the second space, and it is therefore possible to reliably avoid oil backflow. Moreover, using a valve which uses centrifugal force makes it possible to reliably avoid oil backflow with a simple structure.

An airtight compressor according to an eighth aspect of the present invention is the airtight compressor according to any of the first through seventh aspects, wherein carbon dioxide is used as the gas medium.

A carbon dioxide refrigerant which has higher pressure than other commonly used refrigerants is used as the gas medium, but even if high-viscosity oil that is compatible with high-pressure carbon dioxide refrigerant is used, the oil backflow can still be prevented by the second channel, and damage to the discharge valve and other components can therefore be avoided.

Advantageous Effects of Invention

According to the first aspect of the present invention, when the compressor stops, the gas medium is allowed to flow back through the second channel without passing through the oil supply passage, equalizing the pressure between the gas retention space and the second space, and it is therefore possible to reliably avoid oil backflow.

According to the second aspect of the present invention, the desired passage resistance difference can be reliably obtained without the need to make any large design changes to the structure of existing compressors.

According to the third aspect of the present invention, it is possible to prevent the oil from being drawn back in when the compressor stops and to effectively remove foamed refrigerant gas which forms within the second space during normal operation and which has a harmful effect on the supply of oil.

According to the fourth aspect of the present invention, it is possible to reliably obtain the desired passage resistance difference without the need to make any large design changes to the structure of existing compressors.

According to the fifth aspect of the present invention, it is possible to avoid the damage to the sliding portion which occurs in a conventional rotary compressor due to the blade sliding over the external peripheral surface of the roller, and it is possible to prevent oil backflow.

According to the sixth aspect of the present invention, using a valve which uses centrifugal force makes it possible to reliably avoid oil backflow with a simple structure.

According to the seventh aspect of the present invention, when the compressor stops, the gas medium is allowed to flow back through the second channel without passing through the oil supply passage, equalizing the pressure between the gas retention space and the second space, and it is therefore possible to reliably avoid oil backflow. Moreover, using a valve which uses centrifugal force makes it possible to reliably avoid oil backflow with a simple structure According to the eighth aspect of the present invention, even if high-viscosity oil that is compatible with high-pressure carbon dioxide refrigerant is used, the oil backflow can still be prevented by the second channel, and damage to the discharge valve and other components can therefore be avoided.

DESCRIPTION OF EMBODIMENTS

Next, embodiments of the airtight compressor of the present invention will be described with reference to the drawings.

First Embodiment

Configuration of Airtight Compressor 1

Figure 1:
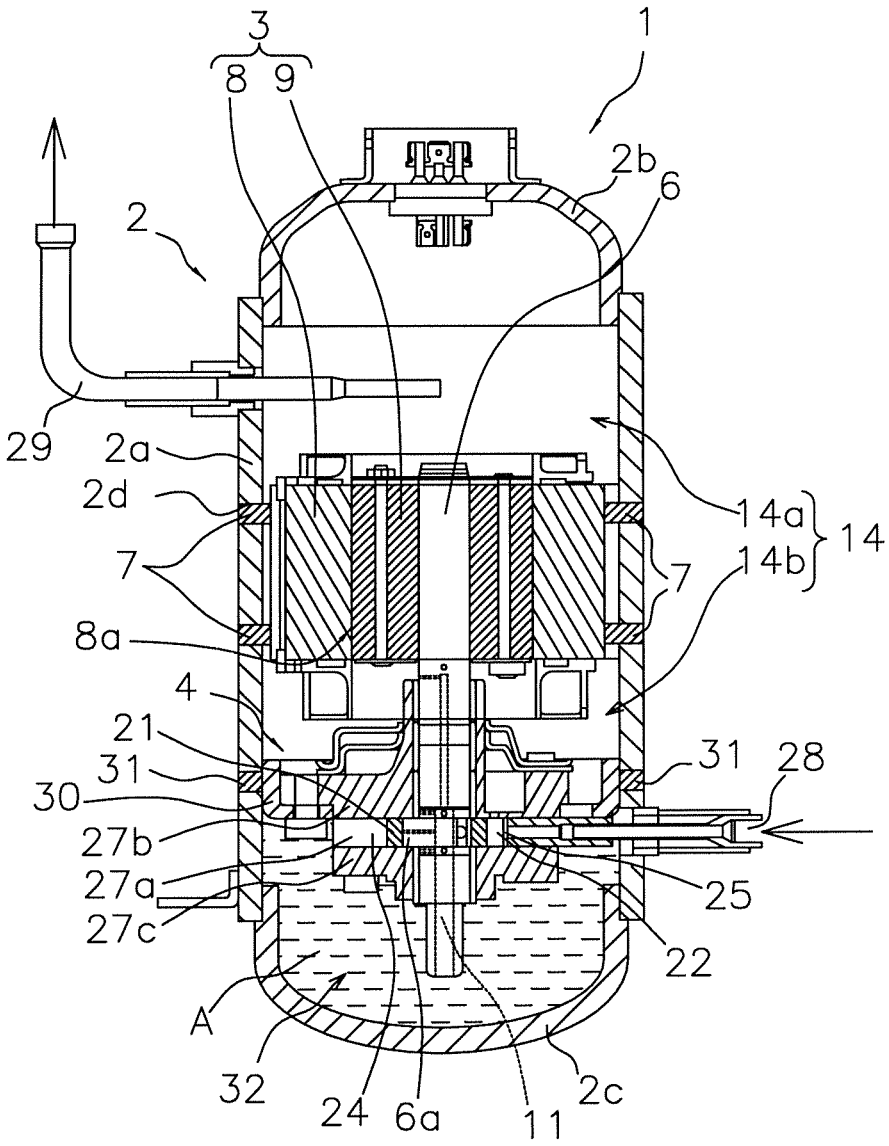
FIG. 1 is a structural drawing of the airtight compressor according to the first embodiment of the present invention.
Figure 2:
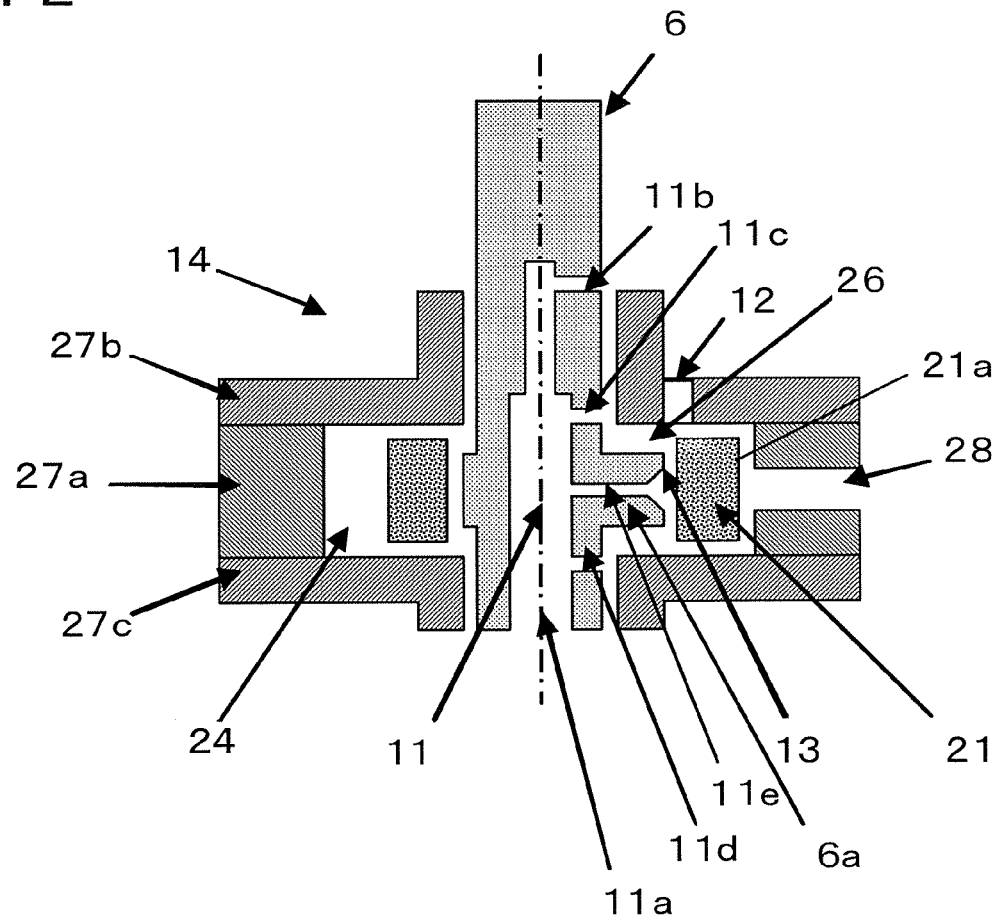
FIG. 2 is an enlarged vertical cross-sectional view of the peripheral area around the oil supply passage and the second channel of FIG. 1.
Figure 3:
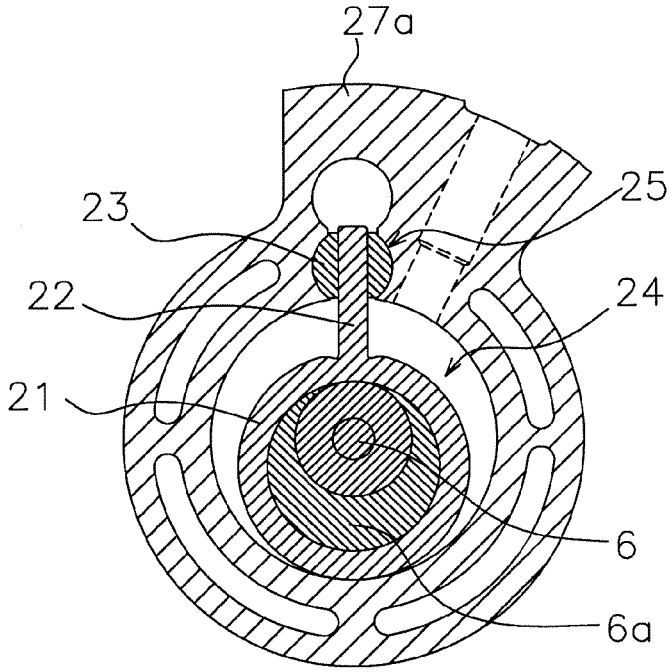
FIG. 3 is a horizontal cross-sectional view of the compression mechanism of FIG. 1.

A swinging airtight compressor 1 shown in FIGS. 1 through 3 comprises a casing 2, a motor 3, a compression mechanism 4, a shaft 6, an oil reservoir 32, an oil supply passage 11, and a second channel 12 (see FIG. 2).

The motor 3, the compression mechanism 4, and the shaft 6 are housed within the casing 2. The compression mechanism 4 is a single-cylinder swinging compressor, having a swinging piston 21, a blade 22, a bush 23, and a cylinder 27*a*, which will be described hereinafter.

The casing 2 is an airtight container having a tubular part 2*a* and a pair of plates 2*b*, 2*c* which close of the open ends at the top and bottom of the tubular part 2*a*. The tubular part 2*a* of the casing 2 houses a motor stator 8 and a motor rotor 9 of the motor 3. The casing 2 also has the oil reservoir 32 for storing oil A below the compression mechanism 4. The oil A is used to lubricate the compression mechanism 4 and other components, and is filled along with a $CO_2$ refrigerant into the casing 2. The internal pressure of the casing 2 when filled with the $CO_2$ refrigerant is a high pressure (about 12 MPa).

The casing 2 has a gas retention space 14 in which the compressed $CO_2$ refrigerant is temporarily retained in an upper part of an airtight space therein. The gas retention space 14 has a portion 14*a* on the side above the motor 3 and a portion 14*b* on the side below. The portion 14*a* and the portion 14*b* are communicated through gaps inside and outside the motor 3. The gas retention space 14 is communicated with a discharge tube 29.

The compression mechanism 4 is disposed in a position beneath the gas retention space 14. Furthermore, the oil reservoir 32 is disposed in a position beneath the compression mechanism 4.

The motor 3 has an annular motor stator 8, and a motor rotor 9 disposed so as to freely rotate in an inside space 8*a* of the motor stator 8. The motor rotor 9 is connected to the shaft 6 and is capable of rotating together with the shaft 6. The motor stator 8 is fixed in the tubular part 2*a* by a plurality of point contacts 7 formed by spot welding or another method inside a through-hole 2*d* of the tubular part 2*a*.

<Configuration of Compression Mechanism 4>

The compression mechanism 4 has the swinging piston 21, the blade 22 which is integrally connected to the swinging piston 21, the bush 23 which swingably supports the blade 22, the cylinder 27*a*, and a front head 27*b* and rear head 27*c* positioned at each end of the cylinder 27*a*, as shown in FIGS. 1 and 3. The front head 27*b* and the rear head 27*c* are bearings that support the shaft 6. The cylinder 27*a* has an intake chamber 24 for housing the swinging piston 21, and a bush hole 25 into which the bush 23 is rotatably inserted. The intake chamber 24 is a space for compressing $CO_2$ refrigerant in its interior, and is equivalent to the first space of the present invention. The compression mechanism 4 is partitioned off from the intake chamber 24 by a seal surface 21*a* of the swinging piston 21, and the compression mechanism 4 has a second space 26 on opposite side of the swinging piston 21 from the intake chamber 24.

The swinging piston 21 swings within the cylinder 27*a* by an eccentric rotation of an eccentric part 6*a* of the shaft 6 which receives the rotational drive force of the motor 3, whereby $CO_2$ refrigerant drawn in from an intake tube 28 is compressed inside the intake chamber 24. The compressed $CO_2$ refrigerant passes through the gas retention space 14 above the compression mechanism 4 and rises inside the casing 2 to be discharged from the discharge tube 29.

The front head 27*b* is screwed onto a mounting plate 30. The mounting plate 30 is fixed to the tubular part 2*a* of the casing 2 by mounting plate contacts 31 formed by spot welding.

<Configuration of Oil Supply Passage 11 and Second Channel 12>

The oil supply passage 11 is formed through the shaft 6 as shown in FIG. 2. The oil supply passage 11 is a passage for supplying the oil A from the oil reservoir 32 to both the gas retention space 14 and the second space 26, and while the compressor is operating, the oil supply passage 11 enables oil to be supplied to the sliding portions of the compression mechanism 4 in the gas retention space 14 and the second space 26. The oil supply passage 11 has an inlet 11*a* into which the oil A flows, the inlet opening into the oil reservoir 32, and a top outlet 11*b* which extends in the radial direction of the shaft 6 and opens into the gas retention space 14 above the front head 27*b*. Furthermore, internal outlets 11*c*, 11*d*, and 11*e* of the oil supply passage 11 are formed respectively in the upper side, lower side, and center of the eccentric part 6*a* of the shaft 6 so as to extend in the radial direction of the shaft 6. The oil supply passage 11 communicates the gas retention space 14 with the second space 26 via the top outlet 11*b* and the internal outlets 11*c*, 11*d*, and 11*e*.

Though not shown in the drawings, a rotary pump, a centrifugal pump, or the like is provided in proximity to the inlet of the oil supply passage 11 at the bottom end of the shaft 6, and it is therefore possible to draw up oil through the oil supply passage 11 inside the shaft 6 from the oil reservoir 32 and supply the oil to the sliding components of the compression mechanism 4 and other components.

The oil supply passage 11 also has at least one narrow passage 13 where the flow passage partially narrows. The narrow passage 13 is a gap in the section where the external peripheral surface of the eccentric part 6*a* of the shaft 6 and the internal peripheral surface of the swinging piston 21 are in surface contact, and is formed in the periphery of the internal outlet 11*e* formed in the center of the eccentric part 6*a*. This oil supply passage 11 communicates the gas retention space 14 and the second space 26 via the narrow passage 13.

The second channel 12 is a channel that is different from the oil supply passage 11, and the second channel 12 enables the flow of the $CO_2$ refrigerant from the gas retention space 14 to the second space 26. The second channel 12 is formed so that the passage resistance when the $CO_2$ refrigerant flows through the second channel 12 is less than the passage resistance when the $CO_2$ refrigerant flows through the oil supply passage 11. For example, the second channel 12 is formed so that the passage resistance is less than that of the oil supply passage 11 due to a larger flow passage diameter, a shorter passage length, or more straight portions of the passage.

The second channel 12 is formed through the front head 27*b*, which is a top side of bearing end plates supporting the shaft 6 in the compression mechanism 4, as shown in FIG. 2. The second channel 12 communicates the gas retention space 14 with the second space 26. The second channel 12 passes through the front head 27*b* without passing through the bearing gap or the sliding seal gap in the front head 27*b* and the rear head 27*c* (e.g. the gaps or the like between the heads 27*b*, 27*c* and the shaft 6), or other narrow passages.

Therefore, when the compressor stops, backflow of the oil A can be reliably avoided because the $CO_2$ refrigerant is allowed to flow back through the second channel 12 of lesser passage resistance without passing through the oil supply passage 11, equalizing the pressure between the gas retention space 14 of the high-pressure side and the second space 26.

Characteristics of First Embodiment (1)

In the first embodiment, there is provided the second channel 12 which has low passage resistance and which makes it possible for the $CO_2$ refrigerant to flow through from the gas retention space 14 to the second space 26 separately from the oil supply passage 11, which supplies oil A from the oil reservoir 32 to the gas retention space 14 and the second space 26 on opposite side of the swinging piston 21 from the intake chamber 24 in the compression mechanism 4. Therefore, when the compressor stops, the $CO_2$ refrigerant is allowed to flow back through the second channel 12 without passing through the oil supply passage 11 to equalize the pressure between the gas retention space 14 and the second space 26, and backflow of the oil A can therefore be reliably avoided. Therefore, high-pressure $CO_2$ refrigerant passes through the second channel 12 of low pressure resistance and instantly moves from the gas retention space 14 to the second space 26, equalizing the pressure, and it is therefore possible at this time to prevent the oil A from being drawn up from the oil reservoir 32 via the inlet 11*a*, of the oil supply passage 11 and flowing back into the second space 26.

(2)

In the first embodiment, the second channel 12 is formed through the front head 27*b*, which is an upper bearing end plate supporting the shaft 6 of the compression mechanism 4 as shown in FIG. 2. The second channel 12 communicates the gas retention space 14 and the second space 26. The second channel 12 passes through the front head 27*b* without passing through the bearing gap in the front head 27*b*, the gap of the sliding seal, or other narrow passages. Therefore, the passage resistance difference with the bearing gap, the gap of the sliding seal, or other narrow passages which are already in proximity to the second channel 12, can be adjusted by managing the dimensions or shape of the second channel 12. As a result, the desired passage resistance difference can be reliably obtained without the need to make any large design changes to the present structure of the compressor.

(3)

In the first embodiment, the top outlet 11*b* of the oil supply passage 11 that opens on the side facing the gas retention space 14 opens in a position higher than the top end of the front head 27*b* supporting the shaft 6 of the compression mechanism 4, and it is therefore possible to prevent the oil A from being drawn back in when the compressor stops and to effectively remove foamed refrigerant gas which forms within the second space 26 during normal operation and which has a harmful effect on the supply of oil.

(4)

In the first embodiment, the oil supply passage 11 has at least one narrow passage 13 where the flow passage partially narrows. Therefore, it is possible to adjust the passage resistance difference with the bearing gap, the gap of the sliding seal, or other narrow passages which are already in proximity to the narrow passage 13 by managing the dimensions or shape of the narrow passage 13, and it is also possible to reliably obtain the desired passage resistance difference without the need to make any large design changes to the present structure of the compressor.

(5)

In the first embodiment, the compression mechanism 4 has at least one cylinder 27*a*, at least one swinging piston 21 which swings within the cylinder 27*a*, and a blade 22 integrally connected with the swinging piston 21. Therefore, it is possible to avoid the damage to the sliding portion which occurs in a conventional rotary compressor due to the blade sliding over the external peripheral surface of the roller, and oil backflow can be prevented.

(6)

Furthermore, in the airtight compressor 1 of the first embodiment, $CO_2$ refrigerant, which has higher pressure than other commonly used refrigerants, is used as the gas medium, but even if high-viscosity oil that is compatible with high-pressure $CO_2$ refrigerant is used, the backflow of the oil A can still be prevented by the second channel 12, and damage to the discharge valve and other components can therefore be avoided.

Modifications of First Embodiment (A)

The airtight compressor 1 of the first embodiment comprises one compression mechanism 4 and performs one-stage compression, but the present invention is not limited to this option. As a modification of the present invention, the present invention may be applied to an airtight compressor 1 for multi-stage compression, in which case the present invention can be applied if the compressor has the oil reservoir and the compression mechanism both provided in the bottom of a high-pressure or intermediate-pressure space. Specifically, if the second channel 12 is provided separately from the oil supply passage 11 connecting the second space 26 and the high-pressure or intermediate-pressure space equivalent to the gas retention space 14 of the present invention and the second channel 12 is designed so as to have less passage resistance than the oil supply passage 11, the pressure is equalized without using the oil supply passage 11; oil backflow thus can be reliably avoided when the compressor stops.

Second Embodiment

Figure 4:
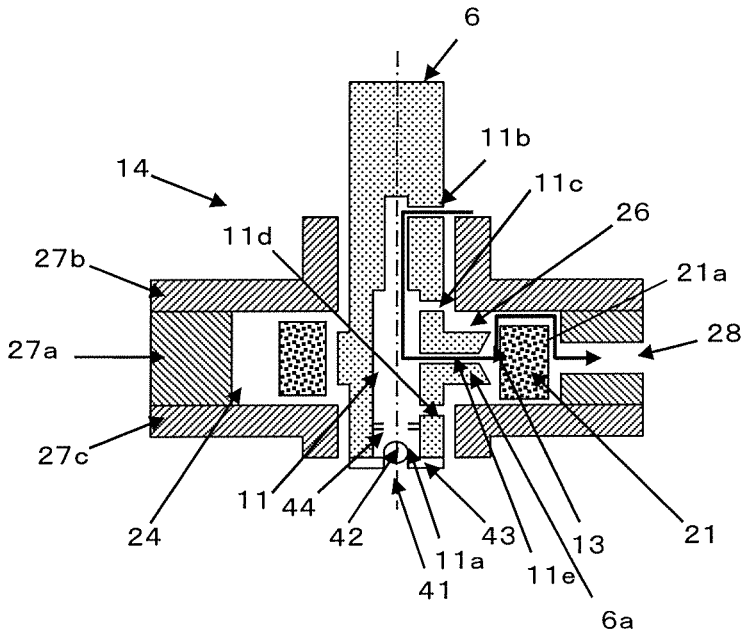
FIG. 4 is an enlarged vertical cross-sectional view of the peripheral area around the oil supply passage and the on/off valve of the airtight compressor according to the second embodiment of the present invention.

The airtight compressor of the second embodiment differs from the airtight compressor 1 of the first embodiment in that as another means for avoiding oil backflow, instead of providing the second channel 12 as in the first embodiment, an on/off valve 41 which opens and closes by centrifugal force is provided to the inlet 11*a* of the oil supply passage 11 as shown in FIG. 4, and the configuration is otherwise the same as the configuration of the airtight compressor 1 of the first embodiment.

Specifically, the airtight compressor of the second embodiment comprises a casing 2, a compression mechanism 4, an oil reservoir 32, an oil supply passage 11, and an on/off valve 41 as shown in FIGS. 1 and 4.

As in the first embodiment, the casing 2 has a gas retention space 14 where compressed $CO_2$ refrigerant is temporarily retained in an upper part of an airtight space.

As in the first embodiment, the compression mechanism 4 is disposed inside the casing 2 in a position below the gas retention space 14, the compression mechanism 4 has an intake chamber 24 and a second space 26 in its interior, and the compression mechanism 4 compresses the $CO_2$ refrigerant in the intake chamber 24 and then expels the refrigerant to the gas retention space 14. The second space 26 is a space in the compression mechanism 4 on opposite side of the swinging piston 21 from the intake chamber 24.

As in the first embodiment, the oil reservoir 32 is disposed inside the casing 2 in a position below the compression mechanism 4, and the oil reservoir 32 retains oil A used to lubricate the compression mechanism 4.

As in the first embodiment, the oil supply passage 11 supplies oil A from the oil reservoir 32 to the sliding portions of the compression mechanism 4 in the gas retention space 14 and the second space 26, and the oil supply passage 11 communicates the gas retention space 14 with the intake chamber 24.

The on/off valve 41 is disposed in the flow inlet 11*a* which is an opening of the oil supply passage 11 on the side facing the oil reservoir 32. The on/off valve 41 opens when subjected to the centrifugal force generated at the time of rotation of the shaft 6 of the compression mechanism 4, and closes when not subjected to the centrifugal force, thereby opening and closing the flow inlet 11*a*.

The on/off valve 41 has a spherical valve body 42, a valve lid 43, and a valve body stopper 44 as shown in FIG. 4. The valve lid 43 is provided to the bottom end of the flow inlet 11*a* of the shaft 6, and a hole smaller than the spherical valve body 42 opens in the valve lid 43. The valve body stopper 44, which regulates the upward movement of the spherical valve body 42, is fixed inside the oil supply passage 11, and a hole smaller than the spherical valve body 42 opens in the valve body stopper 44. The spherical valve body 42 is accommodated in a space between the valve lid 43 and the valve body stopper 44. When the shaft 6 of the compression mechanism 4 rotates, the on/off valve 41 is opened by the spherical valve body 42 moving toward the inner peripheral wall of the oil supply passage 11 and away from the hole of the valve lid 43 due to the centrifugal force generated at this time, allowing the oil A to rise through the oil supply passage 11. When the compressor stops, the shaft 6 ceases to rotate, and the spherical valve body 42 is no longer subjected to the centrifugal force; the spherical valve body 42 closes off the hole of the valve lid 43, and the on/off valve 41 thereby closes. At this time, the spherical valve body 42 is pressed in a direction of closing off the hole of the valve lid 43 due to the pressure difference between the gas retention space 14 and the oil reservoir 32. This allows the equalization of pressure by the flow of high-pressure $CO_2$ refrigerant from the top outlet 11*b* to the internal outlet 11*e* of the oil supply passage 11 as shown by the arrow in FIG. 4 and other flows, but the backflow of oil A from the oil reservoir 32 to the second space 26 can be reliably avoided.

Characteristics of Second Embodiment

In the second embodiment, in the compressor wherein the oil reservoir 32 and the compression mechanism 4 are both provided in the bottom of a high-pressure or intermediate-pressure space, the on/off valve 41, which opens and closes due to centrifugal force, is provided in proximity to the flow inlet 11*a* of the oil supply passage 11.

The drawing back in of oil A during gas backflow, which occurs through the oil supply passage 11 when the compressor stops, occurs due to the minuscule pressure difference in the oil supply passage 11; therefore, using the on/off valve 41 which uses centrifugal force makes it possible to reliably avoid the backflow of oil A from the oil reservoir 32 to the second space 26 with a simple structure.

Third Embodiment

Figure 5:
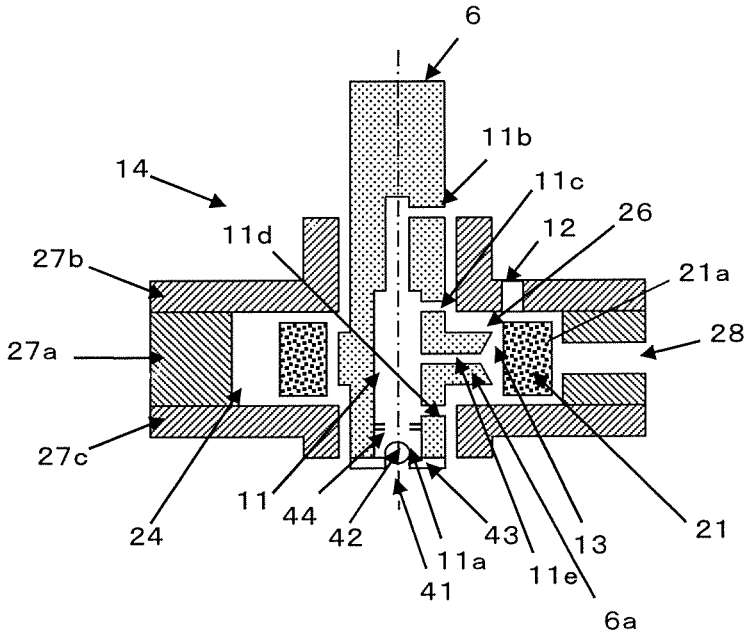
FIG. 5 is an enlarged vertical cross-sectional view of the peripheral area around the oil supply passage and the on/off valve of the airtight compressor according to the third embodiment of the present invention.

The airtight compressor of the third embodiment differs from the airtight compressor 1 of the first embodiment in having, as means for avoiding oil backflow, both the second channel 12 of the first embodiment and the on/off valve 41 of the second embodiment which opens and closes due to centrifugal force in the inlet 11*a* of the oil supply passage 11, as shown in FIG. 5. The configuration is otherwise the same as the configuration of the airtight compressor 1 of the first embodiment.

Specifically, the airtight compressor of the third embodiment comprises a casing 2, a compression mechanism 4, an oil reservoir 32, an oil supply passage 11, a second channel 12, and an on/off valve 41.

As in the first embodiment, the casing 2 has a gas retention space 14 where compressed $CO_2$ refrigerant is temporarily retained in an upper part of an airtight space.

As in the first embodiment, the compression mechanism 4 is disposed inside the casing 2 in a position below the gas retention space 14, the compression mechanism 4 has an intake chamber 24 as a first space and a second space 26 in its interior, and the compression mechanism 4 compresses the $CO_2$ refrigerant in the intake chamber 24 and then expels the refrigerant to the gas retention space 14. The second space 26 is partitioned from the intake chamber 24 by the seal surface 21*a* of the swinging piston 21, and is a space on opposite side of the swinging piston 21 from the intake chamber 24.

As in the first embodiment, the oil reservoir 32 is disposed inside the casing 2 in a position below the compression mechanism 4, and the oil reservoir 32 retains oil A used to lubricate the compression mechanism 4.

As in the first embodiment, the oil supply passage 11 supplies oil A from the oil reservoir 32 to the sliding portions of the compression mechanism 4 in the gas retention space 14 and the second space 26 and communicates the gas retention space 14 with the second space 26.

Though not shown in the drawing, a rotary pump, a centrifugal pump, or the like is provided in proximity to the inlet of the oil supply passage 11 at the bottom end of the shaft 6, and it is therefore possible to draw up oil from the oil reservoir 32 through the oil supply passage 11 within the shaft 6 and supply the oil to the sliding portions of the compression mechanism 4 and other components.

The on/off valve 41 has a spherical valve body 42, a valve lid 43, and a valve body stopper 44 as shown in FIG. 5. The valve lid 43 is provided to the bottom end of the flow inlet 11*a* of the shaft 6, and a hole smaller than the spherical valve body 42 opens in the valve lid 43. The valve body stopper 44, which regulates the upward movement of the spherical valve body 42, is fixed inside the oil supply passage 11, and a hole smaller than the spherical valve body 42 opens in the valve body stopper 44. The spherical valve body 42 is accommodated in a space between the valve lid 43 and the valve body stopper 44. When the shaft 6 of the compression mechanism 4 rotates, the on/off valve 41 is opened by the spherical valve body 42 moving toward the inner peripheral wall of the oil supply passage 11 and away from the hole of the valve lid 43 due to the centrifugal force generated at this time, allowing the oil A to rise through the oil supply passage 11. When the compressor stops, the shaft 6 ceases to rotate, and the spherical valve body 42 is no longer subjected to the centrifugal force; the spherical valve body 42 closes off the hole of the valve lid 43, and the on/off valve 41 thereby closes. At this time, the spherical valve body 42 is pressed in a direction of closing off the hole of the valve lid 43 due to the pressure difference between the gas retention space 14 and the oil reservoir 32. This allows the equalization of pressure by the flow of high-pressure $CO_2$ refrigerant primarily through the second channel 12 (and somewhat through the oil supply passage 11), but the backflow of oil A from the oil reservoir 32 to the second space 26 can be reliably avoided.

Characteristics of Third Embodiment (1)

In the third embodiment, the second channel 12, which enables the flow of $CO_2$ refrigerant from the gas retention space 14 to the second space 26 and which has low passage resistance, is provided separately from the oil supply passage 11 which supplies oil A from the oil reservoir 32 to the gas retention space 14 and the second space 26. Therefore, when the compressor stops, the $CO_2$ refrigerant is allowed to flow back through the second channel 12 without passing through the oil supply passage 11 to equalize the pressure between the gas retention space 14 and the second space 26, and it is therefore possible to reliably avoid the backflow of oil A. Therefore, the high-pressure $CO_2$ refrigerant instantly moves from the gas retention space 14 through the second channel 12 of low passage resistance to the second space 26, equalizing the pressure, and the oil A is therefore drawn up at this time from the oil reservoir 32 via the inlet 11*a* of the oil supply passage 11, making it possible to avoid backflow into the second space 26.

(2)

Furthermore, in the third embodiment, in a compressor in which the oil reservoir 32 and the compression mechanism 4 are both provided to the bottom of a high-pressure or intermediate-pressure space, the on/off valve 41 which opens and closes due to centrifugal force is provided in proximity to the flow inlet 11*a* of the oil supply passage 11.

The drawing back in of oil A during gas backflow, which occurs through the oil supply passage 11 when the compressor stops, occurs due to the minuscule pressure difference in the oil supply passage 11; therefore, using the on/off valve 41 which uses centrifugal force, makes it possible to reliably avoid the backflow of oil A from the oil reservoir 32 to the second space 26 with a simple structure.

INDUSTRIAL APPLICABILITY

The present invention can be applied to an airtight compressor having a gas retention space where a compressed gas medium is temporarily retained in an upper part of an airtight space, wherein a compression mechanism and an oil reservoir are disposed in a position below the gas retention space. Therefore, the compression mechanism can be applied not only to a compressor in which the rotor and blade are integrated as demonstrated in the embodiments, but also to a rotary compressor in which the rotor and blade are separate, as well as compressors of various other compression systems.

What is claimed is:

1. An airtight compressor comprising:

an airtight container having an airtight space with a gas retention space in which a compressed gas medium is temporarily retained in an upper part of the airtight space;

a compression mechanism disposed inside the airtight container in a position below the gas retention space, the compression mechanism having an intake chamber as a first space, and a second space partitioned from the intake chamber by a seal surface of a piston and that is located on an opposite side of the piston from the intake chamber, the compression mechanism being arranged to compress the gas medium in the intake chamber and then to expel the gas medium to the gas retention space;

an oil reservoir disposed inside the airtight container in a position below the compression mechanism, the oil reservoir being arranged to retain oil used to lubricate the compression mechanism;

an oil supply passage arranged to supply the oil from the oil reservoir both to the gas retention space and to a sliding portion of the compression mechanism in the second space, and to communicate the gas retention space and the second space; and a second channel which is a channel that is different from the oil supply passage, the second channel being arranged to enable the gas medium to flow from the gas retention space to the second space, a passage resistance when the gas medium flows through the second channel is less than a passage resistance when the gas medium flows through the oil supply passage.

2. The airtight compressor according to claim 1, wherein the second channel is formed through an end plate of a bearing that supports a rotating shaft of the compression mechanism, and the second channel is further arranged to communicate the gas retention space with the second space.

3. The airtight compressor according to claim 2, wherein an opening of the oil supply passage on a side facing the gas retention space opens in a position higher than a top end of the end plate of the bearing that supports the rotating shaft of the compression mechanism.

4. The airtight compressor according to claim 3, wherein the oil supply passage has at least one narrow passage where the oil supply passage partially narrows, and the gas retention space and the second space are communicated via the narrow passage.

5. The airtight compressor according to claim 4, wherein the compression mechanism includes at least one cylinder;

at least one swinging piston arranged to swing within the cylinder; and a blade integrally connected to the swinging piston.

6. The airtight compressor according to claim 2, wherein the oil supply passage has at least one narrow passage where the oil supply passage partially narrows, and the gas retention space and the second space are communicated via the narrow passage.

7. The airtight compressor according to claim 2, wherein the compression mechanism includes at least one cylinder;

at least one swinging piston arranged to swing within the cylinder; and a blade integrally connected to the swinging piston.

8. The airtight compressor according to claim 1, wherein an opening of the oil supply passage on a side facing the gas retention space opens in a position higher than a top end of an end plate of a bearing that supports a rotating shaft of the compression mechanism.

9. The airtight compressor according to claim 8, wherein the oil supply passage has at least one narrow passage where the oil supply passage partially narrows, and the gas retention space and the second space are communicated via the narrow passage.

10. The airtight compressor according to claim 8, wherein the compression mechanism includes at least one cylinder;

at least one swinging piston arranged to swing within the cylinder; and a blade integrally connected to the swinging piston.

11. The airtight compressor according to claim 1 wherein the oil supply passage has at least one narrow passage where the oil supply passage partially narrows, and the gas retention space and the second space are communicated via the narrow passage.

12. The airtight compressor according to claim 11, wherein the compression mechanism includes at least one cylinder;

at least one swinging piston arranged to swing within the cylinder; and a blade integrally connected to the swinging piston.

13. The airtight compressor according to claim 1, wherein the compression mechanism includes at least one cylinder;

at least one swinging piston arranged to swing within the cylinder; and a blade integrally connected to the swinging piston.

14. The airtight compressor according to claim 1, wherein carbon dioxide is used as the gas medium.

15. An airtight compressor comprising:

an airtight container having an airtight space with a gas retention space in which a compressed gas medium is temporarily retained in an upper part of the airtight space;

a compression mechanism disposed inside the airtight container in a position below the gas retention space, the compression mechanism having an intake chamber as a first space, and a second space partitioned from the intake chamber by a seal surface of a piston and that is located on an opposite side of the piston from the intake chamber, the compression mechanism being arranged to compress the gas medium in the intake chamber and then to expel the gas medium to the gas retention space;

an oil reservoir disposed inside the airtight container in a position below the compression mechanism, the oil reservoir being arranged to retain oil used to lubricate the compression mechanism;

an oil supply passage arranged to supply the oil from the oil reservoir both to the gas retention space and to a sliding portion of the compression mechanism in the second space, and to communicate the gas retention space and the second space;

a second channel which is a channel that is different from the oil supply passage, the second channel enabling the gas medium to flow from the gas retention space to the second space; and a valve disposed in a flow inlet, the flow inlet being an opening of the oil supply passage on a side facing the oil reservoir, the valve being arranged and configured to open and close the flow inlet by opening when subjected to centrifugal force generated at a time of rotation of a rotating shaft of the compression mechanism, and by closing when not subjected to centrifugal, a passage resistance when the gas medium flows through the second channel is less than a passage resistance when the gas medium flows through the oil supply passage.

16. The airtight compressor according to claim 15, wherein carbon dioxide is used as the gas medium.

* * * * *